US005799715A

United States Patent [19]

Biro et al.

[11] Patent Number: 5,799,715

[45] Date of Patent: Sep. 1, 1998

[54] LIFTABLE WINDOW COVERING WITH MULTIPLE LIFTING CORDS AND A SINGLE PULL CORD

[76] Inventors: Michael Julius Biro, 4014 NW. 24th Ter., Boca Raton, Fla. 33431; Walter Biro, 855 Nafa Dr., Boca Raton, Fla. 33487

[21] Appl. No.: 984,432

[22] Filed: Dec. 3, 1997

[51] Int. Cl.[6] ..... E06B 9/30

[52] U.S. Cl. ..... 160/170 R; 160/84.04

[58] Field of Search ..... 160/170 R, 171 R, 160/168.1 R, 173 R, 172 R, 84.04, 84.05, 84.01, 319, 321

[56] References Cited

U.S. PATENT DOCUMENTS

| | | | |
|---|---|---|---|
| 597,046 | 1/1898 | Wilson . | |
| 1,808,455 | 3/1931 | Duncanson . | |
| 2,029,143 | 1/1936 | Wicks | 156/17 |
| 2,250,106 | 7/1941 | Lorentzen | 160/170 R |
| 2,420,301 | 5/1947 | Cusumano | 160/170 R |
| 2,687,769 | 8/1954 | Gershuny | 160/170 R |
| 3,645,317 | 2/1972 | Malone | 160/168 |
| 5,316,065 | 5/1994 | Alligood | 160/170 |

*Primary Examiner*—David M. Purol
*Attorney, Agent, or Firm*—Ronald V. Davidge

[57] ABSTRACT

A liftable window closure, such as a Venetian blind or Roman shade, is lifted and held in place by two or more lifting cords, each of which is wrapped and unwrapped from a section of a spool. The spool is in turn rotated by a single pull cord, which is held in place by a brake mechanism. Each lifting cord is guided onto its spool section by a guide structure directing the cord to a central part of the spool section. A housing extends across the top of the liftable window covering, with the lifting cords extending within the housing and downward through the window covering. In a Venetian blind, a mechanism for tilting the slats extends above the lifting cords, which are held downward by the guide structure.

20 Claims, 4 Drawing Sheets

LIFTABLE WINDOW COVERING WITH MULTIPLE LIFTING CORDS AND A SINGLE PULL CORD

BACKGROUND OF THE INVENTION

1. Field of the Invention

This invention relates to window coverings with liftable portions, such as Venetian blinds, and, more particularly, to a method for eliminating a strangulation hazard for small children by eliminating the double cord construction normally used to lift such liftable portions.

2. Background Information

Conventional Venetian blinds use two, three, or four cords, each descending from a housing at the top of the blind structure through slots in the slats to a lifting bar below the slats, to lift the slats when the blind is raised. The number of cords is generally dependent on the width of the blind. These cords run within the housing to descend together through an opening near the end of the housing. These multiple cords are tied together at a distal end descending near a right or left side of the Venetian blind, so that they are always pulled together to raise the lifting bar and slats in a horizontal configuration.

Other conventional forms of window coverings are lifted in the same way. For example, a Roman shade uses a fan-folded flexible member extending downward to a lifting bar, with cords extending through slots in the flexible member to the lifting bar. Again, these cords are tied together at descending distal ends so that they are always pulled together.

One problem with this conventional method is that young children can become entangled between or among the cords descending toward their distal end, and may thus become strangled. In a typical application, the distal end of the cords is brought close to the floor when the window covering is raised. To eliminate this hazard, a method is needed to avoid the use of multiple cords descending from the housing to be tied together at their distal end.

DESCRIPTION OF THE PRIOR ART

The patent literature includes U.S. Pat. Nos. 597,046 to Wilson and 1,808,455 to Duncanson, in which a single pull cord is used to rotate a roller extending longitudinally within a housing at the top of a Venetian blind structure, i.e. extending across the width of the Venetian blind at its top. The single pull cord and a pair of lifting cords, descending through slots in the slats to a lifting bar to be fastened at a lifting bar below the slats, are all individually fastened to the roller and wound thereon. The lifting cords descend from the same side of the roller, while the pull cord descends from the opposite side thereof, so that the lifting cords are wound on the roller as the pull cord is unwound, and vice versa.

One reason for early interest in this type of arrangement is probably a desire to emulate the mechanism of a conventional roll-up window shade. However, this method has a disadvantage of taking up a large space within the housing through the use of a long, relatively large, roller. More modern Venetian blind arrangements include a relatively narrow (top to bottom) housing, in which a mechanism extends, independent from the raising mechanism, to arrange for the tilting of the slats. What is needed is a method for providing for the use of a single pull cord while maintaining compatibility with modern Venetian blind mechanism, in which relatively little space is provided within the housing for a lifting mechanism.

U.S. Pat. No. 5,316,065 to Alligood describes a burglar- and storm-resistant cover for windows and doors within which a number of "L"-shaped members, preferably made from steel or aluminum, extend atop one another to close an opening. The members can be raised and tilted. The raising mechanism includes a spool from which two or more lifting cords extend, being individually directed by pulleys through a series of slots in the "L"-shaped members to be fastened to the lowest of these members. The spool may be rotated by means of a single pull cord, which is unwound from the spool to effect the winding of the lifting cords, and vice versa, or alternately by means of an electric motor driving a rotatable shaft geared to turn the spool.

Various characteristics of the Alligood device are dictated by the objectives of burglar- and storm-resistance. The "L"-shaped members are individually stiff and very heavy when compared to the slats of a conventional Venetian blind. The weight of the various parts which must be moved in the Alligood device may be generally considered to be an advantage in winding the lifting cords properly on the spool. Since considerable tension is maintained within the lifting cords and the pull-cord, when it is used, due to the weight of the members being raised or lowered, the cords can be expected to wind properly on the spool without the aid of guiding structures. The relatively heavy duty nature of the Alligood mechanism, including individual pulleys for directing lifting cords downward to the "L"-shaped members, limits its adaptability to a modern Venetian blind system, in which a lifting mechanism is placed in a relatively narrow (from top to bottom) housing, below a separate mechanism used for tilting the slats. In contrast, the Alligood lifting mechanism uses a lifting mechanism operating from the top of the spool and pulleys, with a tilting mechanism, in the embodiment incorporating tilting, below the lifting mechanism.

What is still needed is a way to apply a mechanism having a single pull cord to the relatively light design of a Venetian blind, having a narrow housing. Since the slats of a Venetian blind are relatively light, a guide mechanism is needed if various lifting cords are to be wound on a spool. It is particularly desirable for such a single-pull cord mechanism to fit within a modern, conventional housing structure.

SUMMARY OF THE INVENTION

In accordance with one aspect of the invention, there is provided a housing, from which a liftable window covering descends, a spool mounted to turn at one end of the housing, a number of lifting cords, a guide structure near the spool for guiding the lifting cords to wrap around the spool, and a pull cord. The housing extends across the liftable window covering. A near end of each lifting cord is attached to the spool to wrap around an outer surface of the spool. Each of the lifting cords extends within the housing, and a far end of each of the lifting cords descends from the housing, being attached to the liftable window covering for lifting the liftable window covering. The pull cord has a near end also attached to wrap around a peripheral surface of the spool and a far end descending from the housing. The pull cord and the lifting cords are arranged on the spool so that the lifting cords are wound onto the spool by rotation of the spool and the pull cord is unwound from the spool.

BRIEF DESCRIPTION OF THE DRAWINGS

Preferred embodiments of the subject invention are hereafter described with specific reference being made to the following Figures, in which.

DETAILED DESCRIPTION

Figure 1:
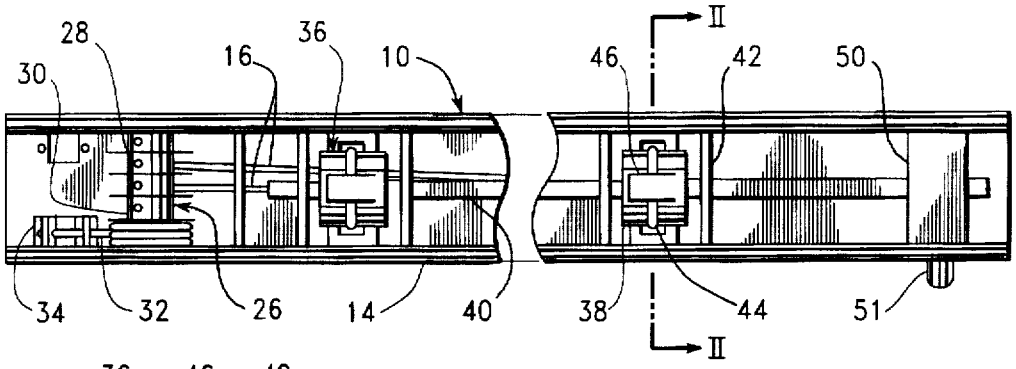
FIG. 1 is plan view of a Venetian blind assembly built according to a first embodiment of the present invention, showing particularly a mechanism within a housing at the top for raising and lowering the blinds.
Figure 2:
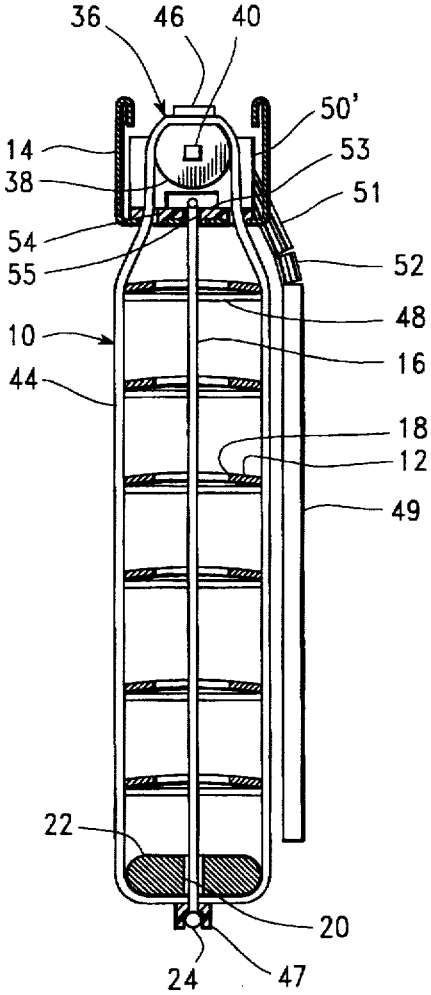
FIG. 2 is a vertical cross-section of the assembly of FIG. 1, taken as indicated by section lines II—II in FIG. 1.

FIGS. 1 and 2 show a Venetian blind assembly built according to a first embodiment of the present invention, with FIG. 1 being a plan view, showing particularly a mechanism for raising and lowering the blinds, while FIG. 2 is a vertical cross-section taken according to section lines II—II of FIG. 1.

Referring to FIGS. 1 and 2, a Venetian blind assembly 10 includes a number of conventional horizontal slats 12, which are raised and tilted by a mechanism within a housing 14 extending across the top of the assembly 10. Specifically, a pair of lifting cords 16 extend downward from housing 14. Each lifting cord 16 extends through a slot 18 in each slat 12, and through a hole 20 in a lifting bar 22, to a knot 24 at its distal end, forming an arrangement assuring that the bar 22 is lifted and held up by the lifting cords 16. The proximal end of each lifting cord is extends around a lower surface of a spool 26, into a cord receiving hole 28 through part of a section 30 of the spool 26. In this way, the lifting cords 16 are simultaneously wound or unwound on spool 26 with rotation of the spool 26.

The rotation of spool 26 is accomplished through pulling or releasing a pull cord 32, which extends from the lower surface of spool 26 opposite the direction in which the lifting cords 16 extend. Thus, pulling pull cord 32 causes this cord 32 to be unwound with the resulting rotation of spool 26, as lifting cords 16 are wound onto spool 26, and as lifting bar 22 is raised. Similarly, releasing pull cord 32 to wind onto spool 26 allows cords 16 to unwind from spool 26 as lifting bar 22 moves downward by means of gravity. In the example of FIGS. 1 and 2, lifting bar 22 is shown in a lowered condition, with the lifting cords unwound from spool 28, and with the pull cord 32 fully wound on the spool 28. A conventional braking mechanism 34 releasably engages pull cord 32, so that the downward motion of lifting bar 22, under the influence of gravity, can be stopped at any point in its vertical travel.

The housing 14 also includes a tilting mechanism 36, which is used to adjust the angle of the slats 12. This mechanism 36 includes a pair of rollers 38 turning with a drive shaft 40, which is rotatably mounted on a pair of "U"-shaped bearing blocks 42. A tilt cord 44 is attached to move with each roller 38, being clamped at an upper end at a flat portion of the roller 38 by means of a clamp 46 and at a lower end on lifting bar 22 by means of a clamp 47. A number of slat support cords 48 extend between each side of tilt cord 44, being spaced along the cord 44 to support the various slats 12 in their spaced-apart relationship when lifting bar 22 is fully lowered. As the rollers 38 are pivoted with rotational movement of drive shaft 40, one side of the tilt cord 44 descending from each roller 38 is lowered, while the other side of the tilt cord 44 is correspondingly raised. The resulting tilting movement of each slat support cord 48 and of lifting bar 24 causes the slats 12 to be correspondingly tilted.

The drive shaft 40 is pivoted by manually rotating a drive handle 49 descending from a gearbox 50, being attached to a rotatable input shaft 51 of the gearbox 50 by means of a universal coupling 52. Conventional gears within gearbox 50 transfer rotational movement of input shaft 51 to rotational movement of the roller drive shaft 40.

Each "U"-shaped bearing block 42 also includes, extending along its lower section 53, a pair of outer apertures 54, through which a tilt cord 44 descends, and a central aperture 55, through which a lifting cord 16 descends. The lifting cord 16 is pulled tightly around a surface of central aperture 55, descending downward to lifting bar 22 in one direction and extending along a lower surface of housing 14 toward spool 28 in the opposite direction. Preferably, the associated surfaces of aperture 55 are rounded to ease the transition occurring as the cord 16 is moved in either direction to raise or lower lifting bar 22. In this way, one end of the portion of lifting cord 16 extending within housing 14 is held downward, below tilt mechanism 36.

Further details of this embodiment of the present invention will now be explained with particular reference being made to FIG. 3, which is an exploded isometric view of a structure rotatably mounting spool 26 and providing guidance and clamping features relative to lifting cords 16 and pull cord 32.

Figure 3:
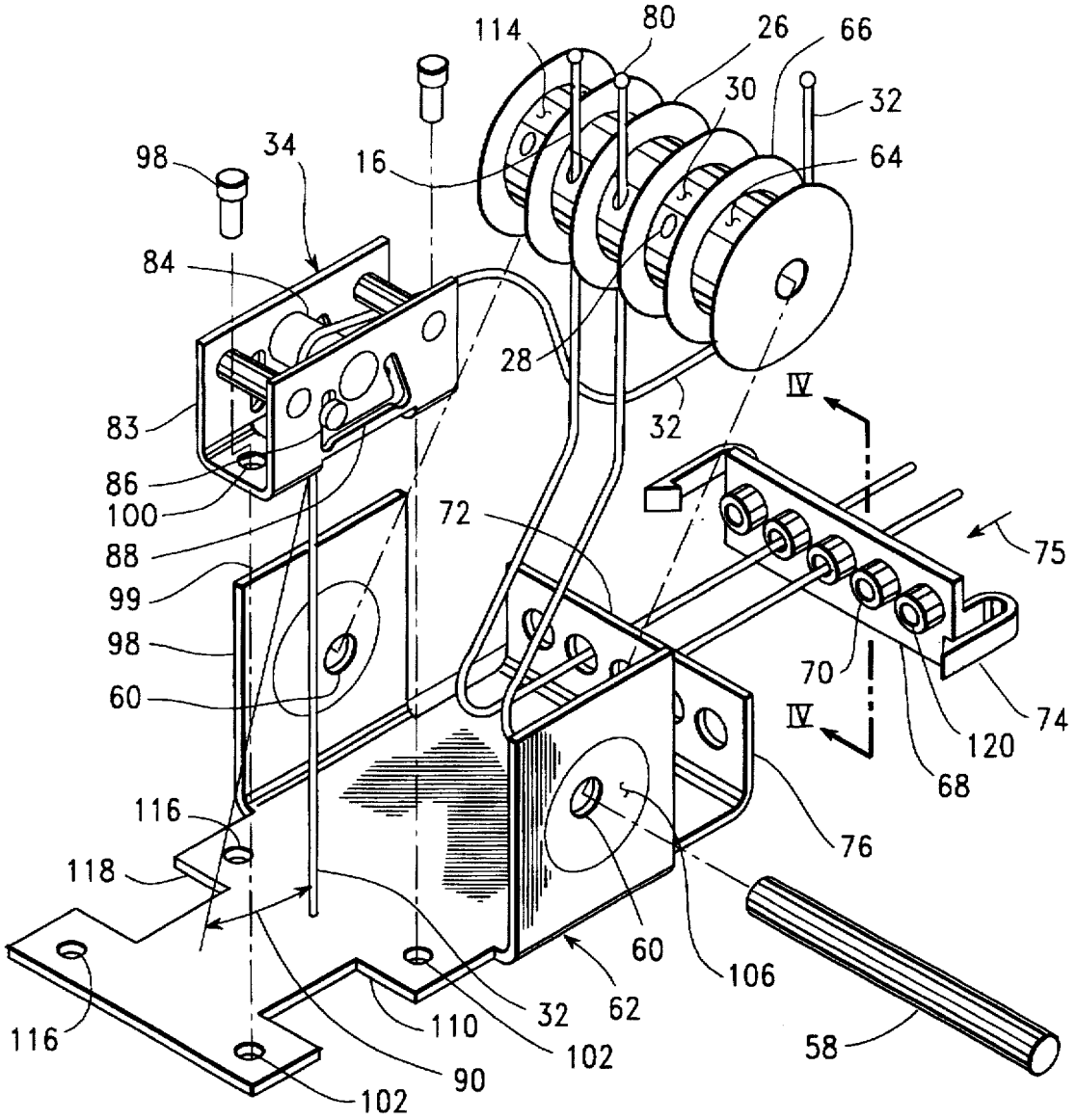
FIG. 3 is an exploded isometric view of a structure rotatably mounting a spool, and guiding and clamping lifting cords, within the Venetian blind assembly of FIG. 1.

Referring to FIG. 3, spool 26 is rotatably mounted on a shaft 58 extending through holes 60 in a spool bracket 62. Means are also provided for guiding up to four lifting cords 16 into and out of four sections 30 of the spool 26. To prevent tangling of the lifting cords 16 with one another, each of these sections 30 is individually provided for, at most, one such cord 18. Thus, these sections 30 are separated from one another and from a section 64, on which the pull cord 32 is wound, by intervening flanges 66. While the examples of FIGS. 1–3 show a relatively narrow Venetian blind assembly 10 having only two lifting cords 16, provisions are made for four such cords so that the mechanism of FIG. 3 can alternately be used in a wider Venetian blind assembly having three or four lifting cords 16.

Figure 4:
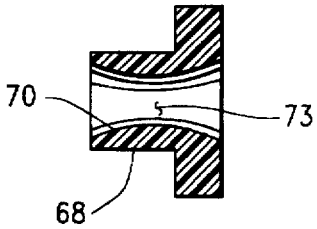
FIG. 4 is a vertical cross-section of a structure used to guide lifting cords in the structure of FIG. 3, taken as indicated by section lines IV—IV in FIG. 3.

FIG. 4 is a vertical cross section, taken as indicated by section lines IV—IV in FIG. 3, through a guiding structure 68, which provides five channels 70 to direct the passage of lifting cords through a flange 72 of spool bracket 62. Guiding structure 68 is preferably molded using a thermoplastic material, with the surfaces of each channel 70 being curved and flared outward in both directions from a central opening 73, so that a rounded edge is presented to the cords being pulled therethrough, despite expected variations in the angle at which the cord is pulled.

Referring to FIGS. 3 and 4, guiding structure 68 also includes, as integral parts, a pair of flexible latches 74, which are deflected outward as the structure 68 is pushed into place, in the direction of arrow 75, onto flange 72, with the latches 74 being forced around flange ends 76. As the motion installing guiding structure 68 is completed, these latches return inward to hold the structure 68 in place.

Each channel 70, being in a proximate relationship with an associated spool section 30, serves to align a lifting cord 16 with the section 30 on which it is wound. Since each individual cord 16 is thus fed centrally onto a spool section 30, a tendency of the cord to build up windings along a flange 66 is eliminated. Each section 30 or 34 includes a hole 28 through which a cord 16 or 32 is fed. An end of 78 of each hole 28 is enlarged to provide space for a knot 79 at the end of the associated cord, which is used to assure that the cord remains attached to the spool 26. Furthermore, each channel 70, together with the deflection of each lifting cord 16 around a surface of an aperture 55 (shown in FIG. 2), holds the each cord 16 down to extend within housing 14 below the tilt mechanism 38 (shown in FIGS. 1 and 2). In this way, the vertical location of each lifting cord 16 within housing 14 is not allowed to vary as the cord 16 is wound onto or unwound from spool 26.

Figure 5:
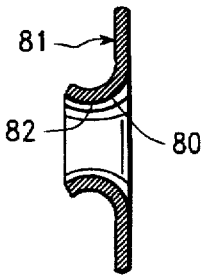
FIG. 5 is a partial vertical cross-section of a guiding bracket, showing an alternative method for guiding lifting cords.

FIG. 5 is a vertical section through a guiding channel portion 80 of an alternative spool bracket 81, which is otherwise similar to spool bracket 62 (shown in FIG. 3). Each channel 82, through which a lifting cord 16 (also shown in FIG. 3) may extend, is rounded and flared so that a curved surface is presented to the cord 16 despite expected variations in the angles at which the cord 16 is pulled through the channel 82.

Referring again to FIG. 3, from spool section 64, pull cord 32 extends through a generally conventional brake mechanism 34, having a bracket 83 supporting a stationary pin 84 and a floating pin 86, which travels within a track 88. If the pull cord, being held to extend downward at an angle 90 from the vertical, is allowed to return upward, frictional contact between the pull cord 32 and floating pin 86 causes the floating pin to move upward in track 88, squeezing the cord 32 against the stationary pin 84. This action prevents further upward motion of the cord 32, allowing the Venetian blind 10 to be raised and held at any position within its travel. Subsequently, pull cord 32 may be released for movement upward or downward by pulling downward, and by holding the pull cord in a direction opposite angle 90 from the vertical, so that floating pin 86 is moved downward within track 88 without being driven back upward.

Figure 6:
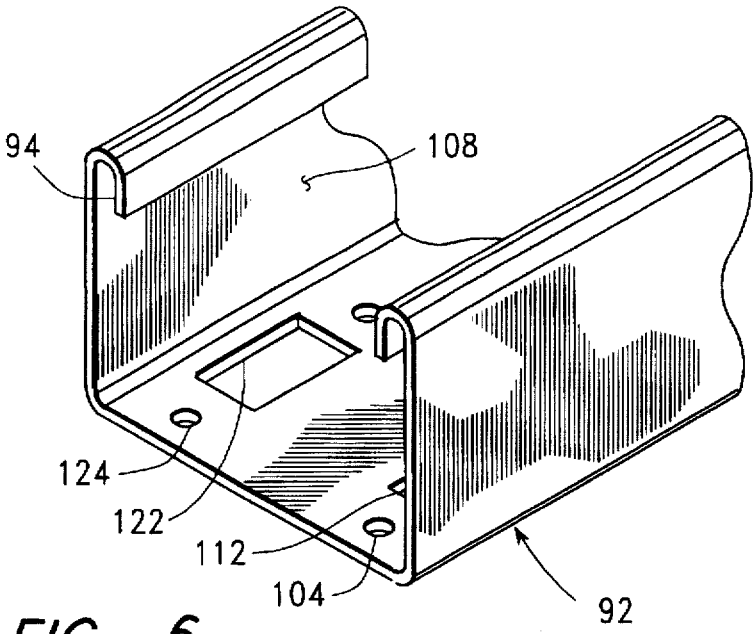
FIG. 6 is an partial isometric view of a conventional channel used in the housing of the assembly of FIG. 1.

FIG. 6 is an isometric view of a channel structure 92 used to form a major part of housing 14 (shown in FIGS. 1 and 2). This channel structure 92 is of a conventional type, otherwise used in conventional Venetian blinds having multiple lifting cords which are tied together at a distal end so that they are pulled together.

Referring to FIGS. 3 and 6, channel structure 92 includes a pair of lips 94 turned inward and downward, extending along upper edges 96. Spool bracket 62 includes a pair of upward extending tabs 98, the top edges 99 of which slide within these lips 94 as the spool bracket 62 is slid into the channel structure 92 in the direction opposite that of arrow 75. The assembly of spool bracket 62 within channel structure 92 is completed when fasteners 98 are driven through holes 100 in bracket 83 of brake mechanism 34, through holes 102 in spool bracket 62, and through holes 104 in channel structure 92. These fasteners 98 may be, for example, rivets or screws with nuts (not shown). Both of the central portions 106 of upstanding tabs 98 are depressed inward, offsetting the shaft mounting holes 60 inward, so that the spool shaft 58 is easily held, extending between these holes 60, by the sidewalls 108 of channel structure 92 after the spool bracket 102 is installed therein. After this assembly process, pull cord 32 descends through a slot 110 in spool bracket 62, and through a slot 112 in channel structure 92. An appropriate handle (not shown) may be attached at the distal end of cord 32 to facilitate pulling.

Various features associated with the handling of cords 16 and 32 are made bilaterally symmetrical within the devices of FIG. 3 to facilitate the use of these devices at either the left or right end of a Venetian blind. In the example of FIGS. 1–3, the pull cord is rigged for operation from the left end of the Venetian blind 10. In any instance, the pull cord should extend on the room side of the blind, rather than between the blind and the wall. Thus, when the pull cord 32 is to be operated from the right end of a Venetian blind, this cord 32 is wrapped around an end spool section 114, instead of around spool section 64, and brake mechanism 34 is mounted to spool bracket 62 with fasteners 98 extending through holes 116, instead of through holes 102, and with the pull cord descending through a slot 118. With this change in configuration, spool section 64 becomes available for use with a lifting cable 16, which extends through an adjacent channel 120 in guiding structure 68. This kind of flexibility may also be achieved in channel structure 92 by providing an additional slot 122 and additional holes 124.

Figure 7:
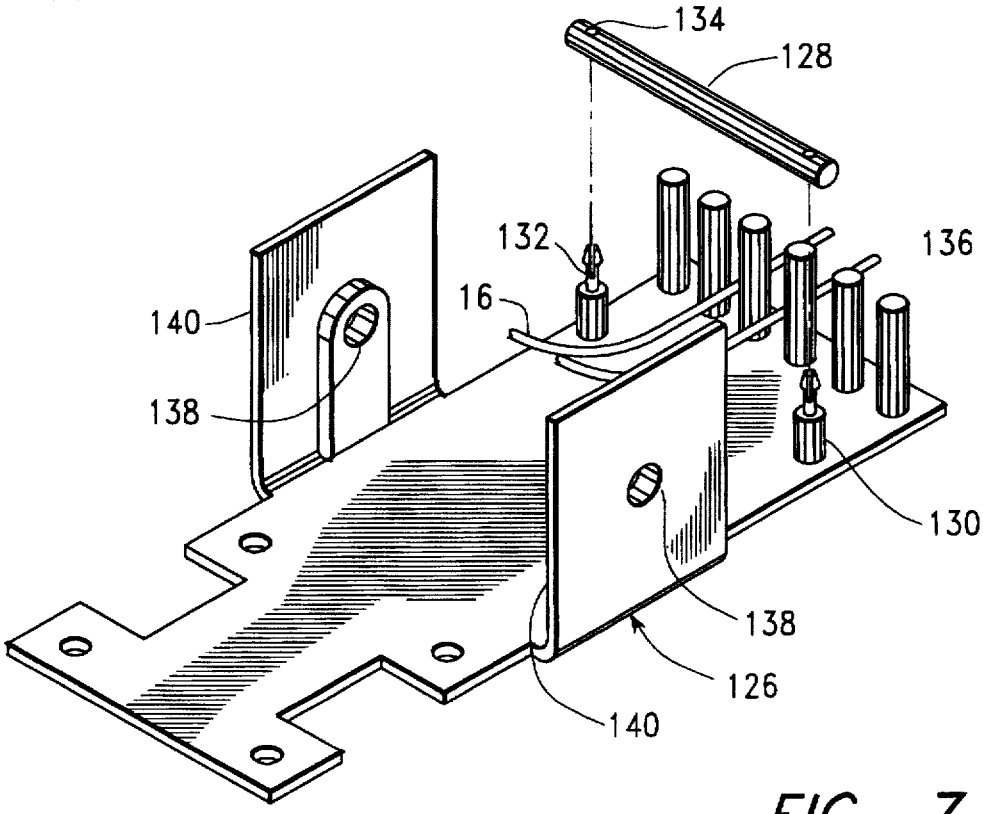
FIG. 7 is an exploded isometric view of an alternative structure for supporting and guiding a spool and cords within the Venetian blind assembly of FIG. 1.

FIG. 7 is an isometric view of an alternative spool bracket 126, which is preferably composed of a thermoplastic material. A horizontal rod 128 is snapped into place on stand-offs 130, to be held in place by flexible latches 132 extending through mounting holes 134. Lifting cords 16 extend individually between adjacent upstanding comb members 136 and under the rod 128. Other features are as described above in reference to FIG. 3, with a spool 26 being rotatably mounted on a shaft 58 (both shown in FIG. 3), extending through holes 138 in upstanding portions 140 of the alternative bracket 126. The upstanding comb members 136 provide the function of holding each lifting cord 16 in centrally in alignment with an adjacent section 30 of the spool 26, while the horizontal bar 128 holds each cord 16 down, so that it extends under the tilt mechanism 36 (shown in FIGS. 1 and 2).

Figure 8:
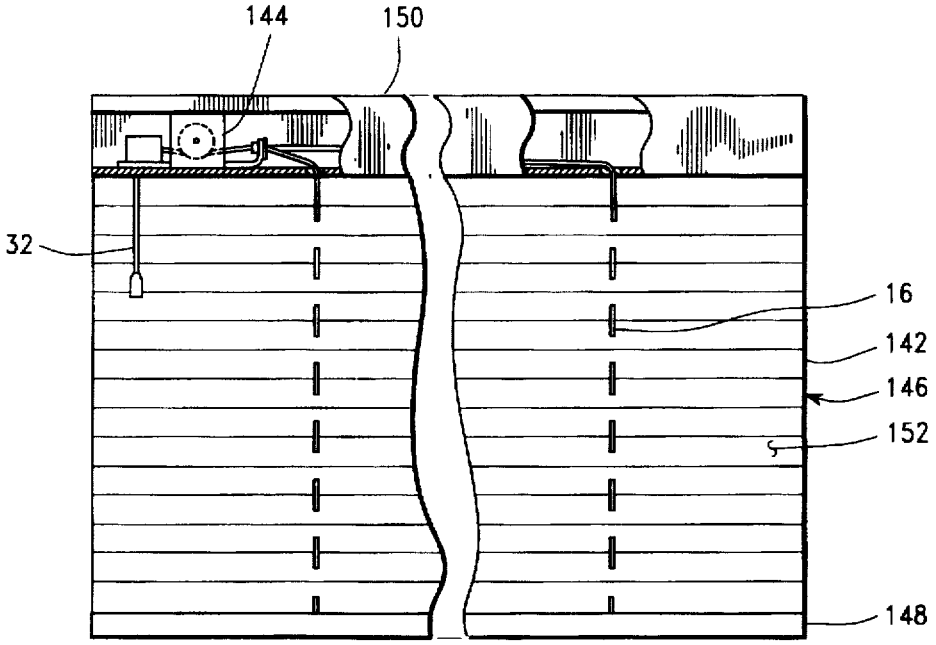
FIG. 8 is an elevational view of a Roman shade assembly in which the structure of FIG. 3 is applied.

FIG. 8 is an elevational view of Roman shade assembly 142 in which the mechanism 144 described above in reference to FIG. 3 is employed. The liftable portion of this assembly 142 includes a fan-folded flexible sheet of material 146 and a lifting bar 148, descending together from a housing 150 holding mechanism 144. Two lifting cords 16 descend through a number of slots in the fan-folded material 146, being attached at distal ends to the lifting bar 148. As the lifting bar is raised by pulling the lifting cords 16, the angles between adjacent segments 152 of the fan folded material 146 are decreased. A tilt mechanism is not present in the housing 150. Other aspects are as discussed above with particular reference to FIG. 3.

The present invention thus has advantages over both conventional Venetian blind and Roman shade mechanisms, which retain multiple cords descending to be tied together at distal ends thereof, and over the cited examples from the patent literature. The present invention provides a lifting system having a single pull cord in a Venetian blind or Roman shade which is generally otherwise conventional, with a narrow housing including, in the example of a Venetian blind, a typical mechanism for tilting the blinds. By contrast, the roller lifting systems of Wilson (U.S. Pat. No. 597,046) and Duncanson (U.S. Pat. No. 1,808,455) include large rollers extending across the blind within the housing. Since the lifting system of Alligood (U.S. Pat. No. 5,316.065) pulls the lifting cords from the top of the spool without the use of channels to hold the cords downward or separate from one another, and since the lifting cords are extend downward around pulleys, the Alligood system cannot be used in the manner of the present invention. Furthermore, the present invention provides a lifting mechanism which is modular in construction and which can be installed in a modern Venetian blind with little if any additional modification.

While the invention has been described in its preferred forms or embodiments with some degree of particularity, it is understood that this description has been given only by way of example and that numerous changes in the details of construction, fabrication and use, including the combination and arrangement of parts, may be made without departing from the spirit and scope of the invention.

What is claimed is:

1. Apparatus comprising:

a housing;

a liftable window covering descending from said housing, with said housing extending across said liftable window covering;

a spool rotatably mounted at an end of said housing;

a plurality of lifting cords, with a proximal end of each of said lifting cords attached to said spool to wrap around a peripheral surface thereof, with each of said lifting cords extending within said housing, and with a distal end of each of said lifting cords descending from said housing in attachment with said liftable window covering for lifting said liftable window covering;

guide means adjacent said spool for guiding said lifting cords into wrapping engagement with said spool; and a pull cord with a proximal end thereof attached to wrap around a peripheral surface of said spool and with a distal end descending from said housing, wherein said pull cord and said lifting cords are arranged on said spool so that said lifting cords are wound onto said spool by rotation of said spool as said pull cord is unwound from said spool.

2. The apparatus of claim 1:

wherein said spool includes a plurality of spool sections separated by intervening flanges;

wherein said proximal end of each of said lifting cords and said proximal end of said pull cord are individually attached to wind within separate said sections; and wherein said guide means aligns each of said lifting cords with a central region of an adjacent said spool section.

3. The apparatus of claim 2, wherein said guide means includes a plurality of apertures, with each said aperture forming a channel in alignment with a said central region.

4. The apparatus of claim 3, wherein said aperture is curved and flared outward in both directions in which it extends from a central opening.

5. The apparatus of claim 2, wherein said guide means includes a plurality of upward-extending comb members, adjacent said comb members forming channels therebetween, with each said channel being in alignment with a said central region.

6. The apparatus of claim 1, wherein each of said lifting cords extends through a channel within said guide means, with each of said lifting cords being held down by an upper surface of said channel.

7. The apparatus of claim 6, wherein said guide means includes a plurality of apertures, with each said aperture being curved and flared outward in both directions in which it extends from a central opening.

8. The apparatus of claim 6, wherein said upper surface is formed as a portion of a bar extending along said guide means.

9. The apparatus of claim 6:

wherein said liftable window covering includes a plurality of slats arranged in a variable spaced-apart relationship descending from said housing, and a lifting bar below said slats, with said distal end of each of said lifting cords descending from said housing through slots within said slats to engage said lifting bar, with a tilt cord extending along each side of said slats, with a plurality of slat support cords attached to extend between two sides of said tilt cord in a spaced-apart relationship, and with each of said slats extending above one of said slat-support cords;

wherein said apparatus additionally includes a tilt mechanism extending within said housing to tilt said slats by raising a first side of said tilt cord while lowering a second side of said tilt cord; and wherein said lifting cords extend within said housing below said tilt mechanism.

10. The apparatus of claim 1, wherein said liftable window covering includes a fan-folded flexible member extending downward from said housing to a lifting bar, with said lifting cords extending through slots within said flexible material to engage said lifting bar.

11. The apparatus of claim 1, additionally comprising a bracket assembly mounting said spool, with said bracket assembly additionally including said guide means.

12. Apparatus for lifting a window covering, wherein said apparatus comprises:

a spool having a plurality of spool sections separated by intervening flanges;

a plurality of lifting cords, with a proximal end of each of said lifting cords attached within one of said spool sections to wrap around a peripheral surface thereof;

a bracket assembly rotatably mounting said spool, wherein said bracket assembly includes guide means adjacent said spool for guiding each of said lifting cords into wrapping engagement with a central region of an adjacent one of said spool sections;

a pull cord with a proximal end thereof attached within one of said spool sections to wrap around a peripheral surface thereof, wherein said pull cord and said lifting cords are arranged on said spool so that said lifting cords are wound onto said spool by rotation of said spool as said pull cord is unwound from said spool.

13. The apparatus of claim 12, wherein said guide means includes a plurality of apertures, with each said aperture forming a channel in alignment with a said central region.

14. The apparatus of claim 13, wherein said aperture is curved and flared outward in both directions in which it extends from a central opening.

15. The apparatus of claim 12, wherein said guide means includes a plurality of upward-extending comb members, adjacent said comb members forming channels therebetween, with each said channel being in alignment with a said central region.

16. The apparatus of claim 12, wherein each of said lifting cords extends through a channel within said guide means, with each of said lifting cords being held down by an upper surface of said channel.

17. The apparatus of claim 16, wherein said guide means includes a plurality of apertures, with each said aperture being curved and flared outward in both directions in which it extends from a central opening.

18. The apparatus of claim 16, wherein said upper surface is formed as a portion of a bar extending along said guide means.

19. The apparatus of claim 12, additionally comprising releasable braking means for holding said pull cord.

20. The apparatus of claim 12, wherein said bracket assembly includes a tab extending to engage a slot within a housing and a fastener to engage a hole within said housing.

* * * * *